US008363074B2

(12) United States Patent
Rawlings et al.

(10) Patent No.: US 8,363,074 B2
(45) Date of Patent: Jan. 29, 2013

(54) DUAL-SIDED THERMAL PRINT FOLDING

(75) Inventors: Timothy W. Rawlings, Waynesville, OH (US); Michael J. VanDemark, Springboro, OH (US); Joseph D. Roth, Springboro, OH (US)

(73) Assignee: NCR Corporation, Duluth, GA (US)

( * ) Notice: Subject to any disclaimer, the term of this patent is extended or adjusted under 35 U.S.C. 154(b) by 239 days.

(21) Appl. No.: 12/800,994

(22) Filed: May 27, 2010

(65) Prior Publication Data

US 2011/0292152 A1 Dec. 1, 2011

(51) Int. Cl.
*B41J 2/32* (2006.01)
*B41J 3/60* (2006.01)

(52) U.S. Cl. ..... 347/171

(58) Field of Classification Search ..... 347/171, 347/175; 400/82, 188
See application file for complete search history.

(56) References Cited

U.S. PATENT DOCUMENTS 6,562,171 B1 * 5/2003 Archie et al. ..... 156/204
6,746,051 B1 * 6/2004 Archie et al. ..... 283/56
6,784,906 B2 * 8/2004 Long et al. ..... 347/171
6,806,308 B2 * 10/2004 Zajac ..... 524/522

* cited by examiner

*Primary Examiner* — Huan Tran
(74) *Attorney, Agent, or Firm* — Joseph P. Merhle; Dana T. Hustins

(57) ABSTRACT

Dual-sided thermal print folding techniques are presented. A dual-sided thermal printer includes a folding mechanism to custom fold a substrate. The substrate is imaged on both sides by the dual-sided thermal printer as it passes through the dual-sided thermal printer and is custom folded by the folding mechanism of the dual-sided thermal printer.

20 Claims, 4 Drawing Sheets

DUAL-SIDED THERMAL PRINT FOLDING

BACKGROUND

Print applications have becoming increasingly complex to meet the growing demands of customers. As a result, businesses may have to hire a variety of custom printing and packaging shots to address their printing needs.

Enlisting third parties to perform custom printing needs has a variety of drawbacks such as: delay in delivery to business customers, increase in expense of hiring a third party, and reduction in custom print applications because of business procedures required to use the third party.

SUMMARY

In various embodiments, a dual-sided thermal printer with a custom folding mechanism is provided. According to an embodiment, a dual-sided thermal printer is presented. The printer includes a dual-sided thermal print mechanism to active images on both sides of a substrate passing through the printer. The printer also includes a folding mechanism configured to custom fold the substrate before the substrate is dispensed from the printer.

DETAILED DESCRIPTION

Figure 1:
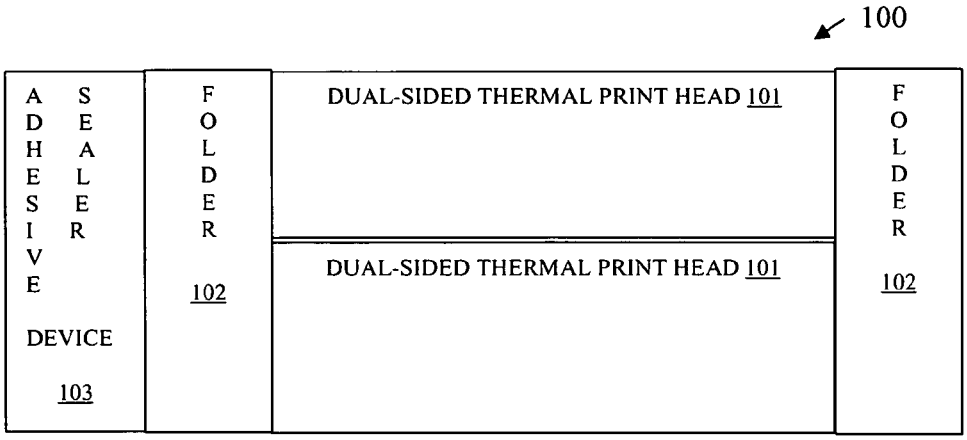
FIG. 1 is a diagram of dual-sided thermal printer, according to an example embodiment.

FIG. 1 is a diagram of dual-sided thermal printer 100, according to an example embodiment. The printer 100 includes one or more processors having instructions that drive movement and/or activation of various components of the printer 100. In some cases, printing via the printer 100 is enabled over a network, such as a local-area network (LAN) or a wide-area network (WAN) (such as the Internet).

The printer 100 includes a dual-sided thermal print mechanism 101 and a folding mechanism 102. In an embodiment, the printer 100 also includes an adhesive application mechanism 103 and/or a sealing mechanism 103. Each of these and their interactions with one another will now be discussed in turn.

The printer 100 includes dual thermal print heads 101. These print heads 101 are configured to selectively apply heat to both sides of a substrate. The substrate is coated on both sides with thermally sensitive inks. The print heads 101 active print messages or images on both sides of the substrate as the substrate passes under or over one of the thermal print heads 101.

The printer 100 also includes a folding mechanism 102. The folding mechanism 102 (folder in the FIG. 1) is configured to custom fold the substrate before the substrate is dispensed from the printer 100.

According to an embodiment, the folding mechanism 102 is a plow folder that folds the substrate as it passes through the printer 100 in the direction of a web of media that comprises the substrate.

In another case, the folding mechanism 102 is a spiral folder that folds the substrate across the web of media.

In fact, a variety of folding mechanisms 102 can be integrated into the printer 100. For example, a plate can be used to bend the substrate, the substrate can be forced against a plate at a certain angle to achieve a desired fold. Moreover, in some cases multiple plates or folds can be used as the folding mechanism, such that a Z-fold is achieved or other types of folds.

In a scenario, the folding mechanism 102 is configured to utilize pre-existing perforations, crimps, creases, and/or die cuts occurring in the substrate to assist in the folding of the substrate as it passes through the printer 100. The pre-existing perforations, crimps, creases, and/or die cuts may be sensed by one or more sensors (e.g., optical sensors—not shown) in the printer 100 for determining a location to initiate and/or perform folding by the folding mechanism 102.

It is noted that a variety of configurations can occur for the placement of the folding mechanism 102 within the printer. So, the folding mechanism 102 can be placed before the dual-sided thermal print mechanism 101 activates the thermal inks on the substrate (e.g., the folding mechanism may be placed upstream of one or both of the thermal print heads 101). Alternatively, the folding mechanism 102 can be configured within the printer 100 to be activated after the dual-sided thermal print mechanism 101 activates the thermal inks on the substrate (e.g., the folding mechanism may be placed downstream of one or both of the thermal print heads 101). It may also be the case that the folding mechanism 102 permits folding to occur in multiple locations within the printer 100 (e.g., before and/or after one or both thermal print heads) as depicted in the FIG. 1.

In an embodiment, the printer 100 also includes an adhesive application mechanism 103. The adhesive application mechanism 103 is configured to selectively apply adhesive to the substrate as the substrate passes through the printer 100. The adhesive application mechanism 103 may dispense adhesive directly onto the substrate or may activate existing pre-applied adhesive on the substrate. Activation can occur in a variety of manners, such as via heat, via ultraviolet (UV) light, or via application of a liquid (rolled, sprayed, etc.).

In another configuration of the printer, the printer includes a sealing mechanism 103 (both the adhesive mechanism and the sealing mechanism are identified as 103 in the FIG. 1). The sealing mechanism 103 is configured to selectively seal a portion of the substrate when the substrate is folded and as the substrate passes through the printer 100. The sealing can occur via adhesive that is applied by the printer 100 or that is activated by the printer 100 as discussed above with reference to the adhesive application mechanism 103.

The substrate includes images activated by the dual-sided thermal print mechanism 101. After the fold, some of the activated images can be intentionally and custom concealed (e.g., located on an inner side of a fold, and thereby concealed from external view). Such configurations may be used to custom conceal privileged and/or sensitive (e.g., confidential) information such as, but not limited to, personal, medical, legal, and/or account information. In addition, a pouch of various configurations of the substrate can be achieved via various custom combinations of folding the substrate, sealing the substrate, crimping the substrate, and the like. In various embodiments, a folding scheme associated with a print job may vary with the content of the print information such that, for example, information tagged and/or otherwise identified to the printer as privileged and/or confidential information is concealed in a fold and/or pouch prior to the media exiting and/or otherwise being discharged from the printer 100. The printer 100 may provide various levels of information security/conceal depending on a degree to which the information is identified to the printer as privileged and/or confidential. In one embodiment, a tag comprising a scalar (e.g., 1, 2, 3, . . . 10), a decimal or fraction (e.g., 0.1, 0.2, . . . 1), a hexadecimal number (e.g., 00, 10, 20, . . . 90), or other parameter (e.g., an escape sequence), and the like, may be sent to the printer 100 to indicate a degree of security/conceal to be provided, with the lowest level (e.g., 1, 0.1, 00, etc.) comprising no security/conceal (e.g., unfolded media), and the highest level (e.g., 10, 1, 90) comprising a fully sealed folded document, or portion thereof, with the privileged/confidential information contained on the inside of the sealed document/region.

The print job, and perhaps a type of substrate passed as a parameter to the print job, drive the dual-sided thermal print mechanism 101, the folding mechanism 102, and/or the adhesive or sealing mechanism to custom create configurations of the substrate as the substrate is dispensed from the printer 100.

Figure 2:
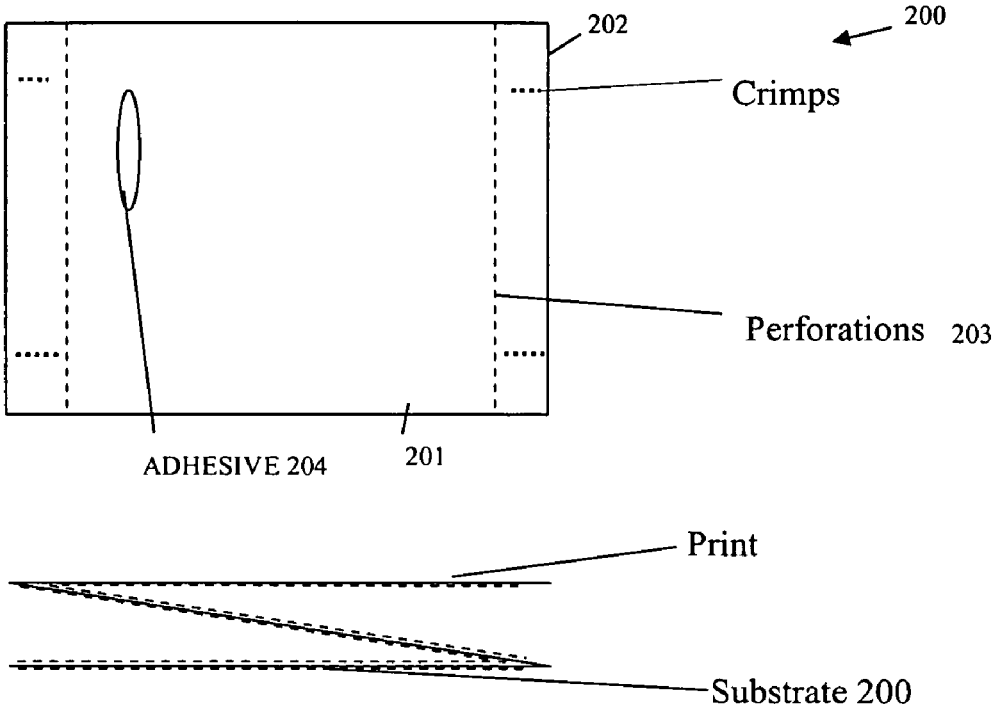
FIG. 2. is a diagram of a substrate, according to an example embodiment.

FIG. 2. is a diagram of a substrate 200, according to an example embodiment. Two different views of the substrate 200 are presented. A first view shows the substrate 200 when looking at the substrate's 200 first side or surface 201. The second view shows the substrate when looking at it from a width perspective to see a type of fold, specifically a Z-fold.

The substrate 200 can be cut from a web into pieces of media that are dispensed from a printer, such as the printer 100 of the FIG. 1.

The substrate 200 includes a first side 201 coated with thermally sensitive inks that a dual-sided thermal printer selectively activates as the substrate passes through the printer.

The substrate 200 also includes a second side 202 coated with the thermally sensitive inks that the dual-sided thermal printer selectively activates as the substrate passes through the printer.

The substrate 200 also includes one or more perforations, crimps, die cuts, or creases 203 (referred to as perforations 203 in the FIG. 2). The perforation 203 is configured to permit the dual-sided thermal printer to fold the substrate 200 along the perforation 203 as the substrate 200 passes through the dual-sided thermal printer.

According to an embodiment, the substrate 200 includes an adhesive 204 selectively coated on one or more sides 201 and/or 202 of the substrate 200 when the substrate is folded by the dual-sided thermal printer along the perforation 203.

It may also be the case that the perforation 203 is to be created on the substrate 200 by the dual-sided thermal printer as the substrate 200 passes through the dual-sided thermal printer.

In another configuration, the perforation 203 is prefabricated on the substrate 200 before the substrate 200 passes through the dual-sided thermal printer.

Figure 3:
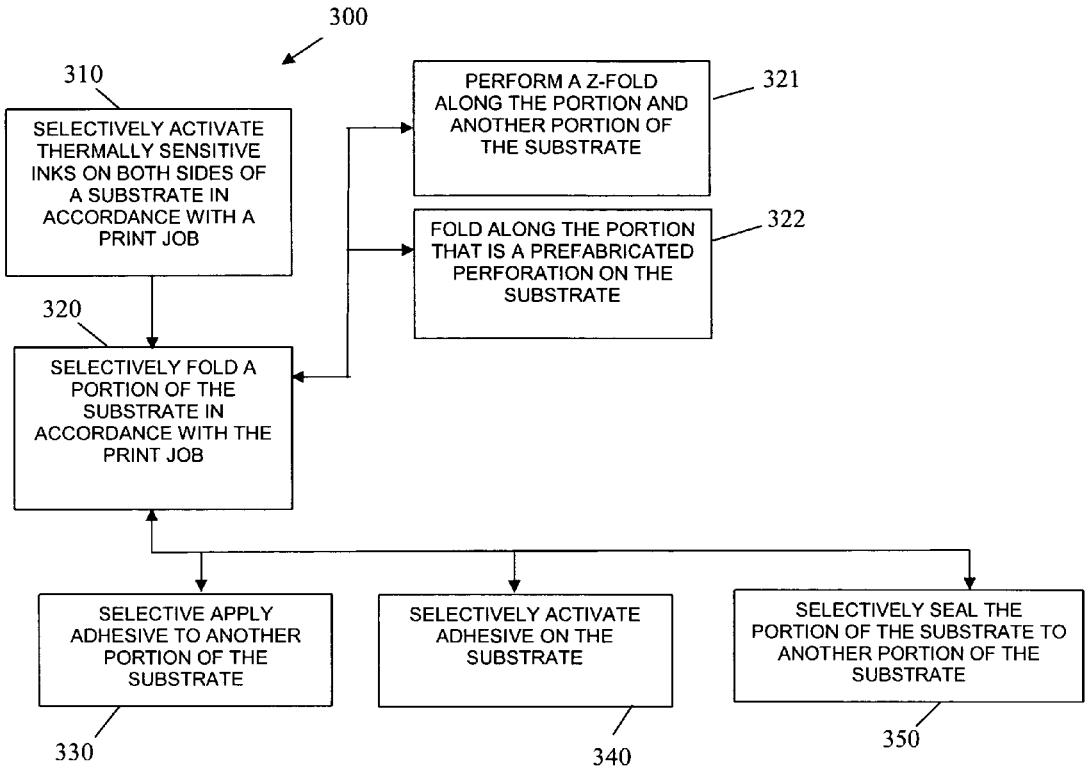
FIG. 3 is a diagram of a method for performing custom dual-sided thermal printing with custom folding, according to an example embodiment.

FIG. 3 is a diagram of a method 300 for performing custom dual-sided thermal printing with custom folding, according to an example embodiment. The method 300 (hereinafter "dual-sided thermal print folder service") is implemented in a non-transitory computer-readable medium and is to execute on one or more processors. The processors are specifically configured to process the dual-sided thermal print folder service. According to an embodiment, the dual-sided thermal print folder service is implemented in one or more of the processors associated with the printer 100 of the FIG. 1 and uses the substrate 200 of the FIG. 2.

At 310, the dual-sided thermal print folder service selectively activates thermally sensitive ink on both sides of a substrate in accordance with a print job. The print job is instructions that drive the components of the dual-sided thermal printer, such as the dual-sided thermal printer 100 of the FIG. 1.

At 320, the dual-sided thermal print folder service selective folds a portion of the substrate in accordance with the print job. The folding can be custom and is driven by the tenets of the print job, such as according to one or more parameters and/or commands transmitted and/or associated with the print job.

In an embodiment, at 321, the dual-sided thermal print folder service performs a Z-fold on the substrate when the substrate is folded. An example Z-fold is shown in the bottom diagram of second view of the FIG. 2.

According to an embodiment, at 322, the dual-sided thermal print folder service folds along the portion where the portion is a prefabricated perforation on the substrate to assist in folding the substrate. An example, perforation 203 is shown in the substrate 200 of the FIG. 2.

In a scenario, at 330, the dual-sided thermal print folder service selectively applies adhesive to another portion of the substrate in accordance with the print job. Here, the dual-sided thermal printer processes the dual-sided thermal print folder service and the printer also includes an adhesive application mechanism, such as the adhesive application mechanism 103 of the FIG. 1.

In another case, at 340, the dual-sided thermal print folder service selectively activates the adhesive on the substrate in accordance with the print job or in accordance with a type associated with the substrate. So, the print job can be configured based on a substrate or media type.

In one situation, at 350, the dual-sided thermal print folder service selectively seals the portion of the substrate to another portion of the substrate when folded. Here, the dual-sided thermal printer processes the dual-sided thermal print folder service and the printer also includes a sealing mechanism, such as the sealing mechanism 103 of the FIG. 1.

Figure 4:
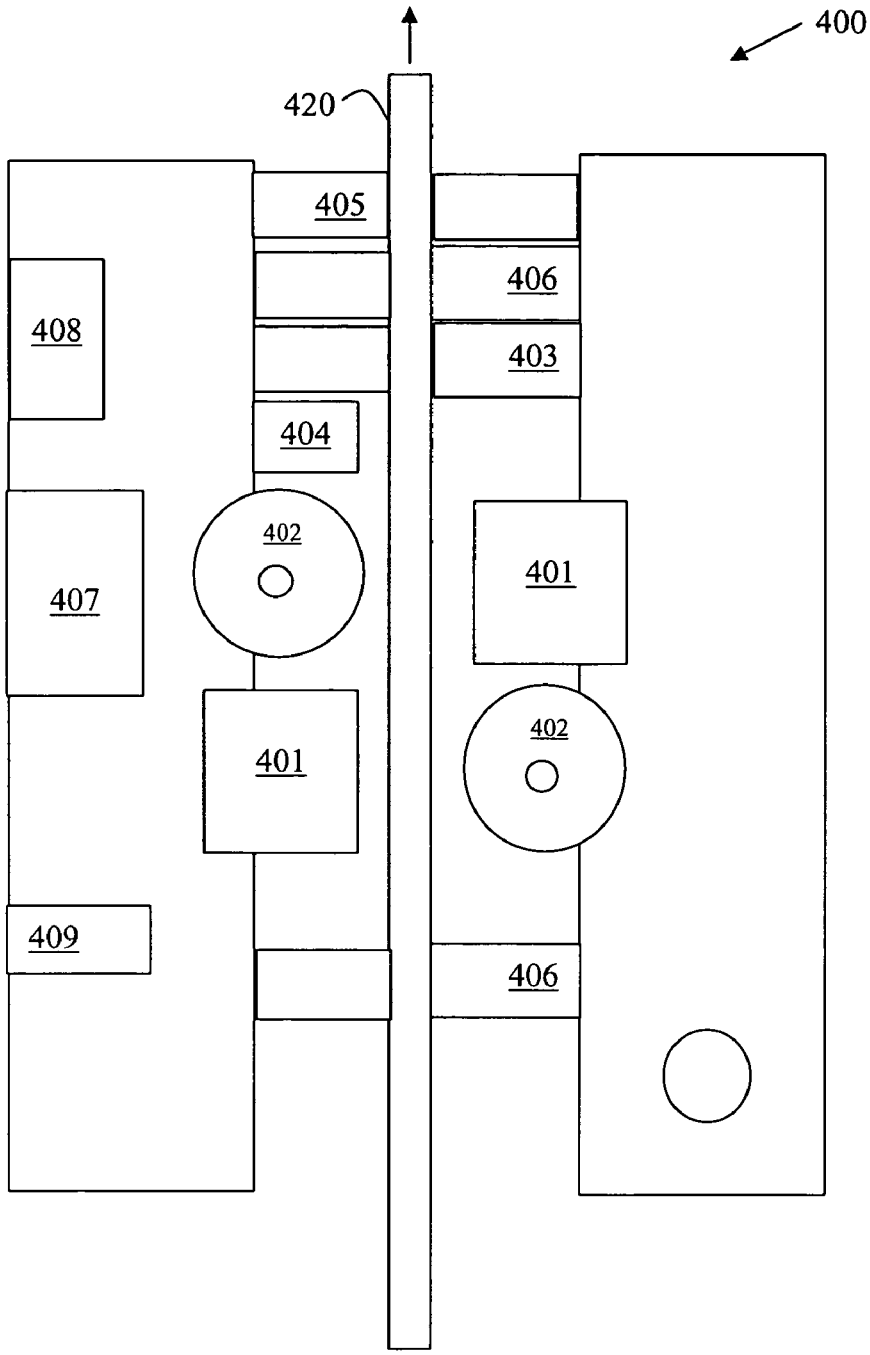
FIG. 4 is a diagram of a dual-sided thermal printer, according to an example embodiment.

FIG. 4 is a diagram of another dual-sided thermal printer 400, according to an example embodiment. The FIG. 4 is another view of a dual-sided thermal printer 400 from that which was shown in the FIG. 1 as dual-sided thermal printer 100.

A printer 400 is operatively connected to a computer or terminal, such as a Point of Sale (POS) terminal, may print via direct thermal printing, whereby a print head 401 selectively applies heat to paper or other sheet media comprising a substrate with a thermally sensitive coating. The coating changes color when heat is applied, by which the ink is activated and "printing" is provided on the coated substrate.

As shown in FIG. 4, a printer 400 may comprise, among other things, platen 402, also referred to herein as a rolling platens 402. The rolling platens 402 may comprise one or more compressive and/or friction enhancing materials (e.g., rubber). Each rolling platen 402 is located opposite a particular print head 401 (e.g., thermal, dual thermal print heads 401 for dual-sided thermal printing) that performs the printing on media.

As further shown in FIG. 4, the printer 400 may further include a cutting mechanism 403, such as a knife/blade, a slitter, a tear bar or strip, and the like. The cutting mechanism 403 may be used to produce a custom cut of installed media 420 (e.g., non-adhesively coated receipt or credit voucher (note adhesive may be applied after the cut via 405), and/or linerless label, material), which media may be provided in sheet and/or roll form.

As shown in FIG. 4, a printer 400 may further include a motor and/or drive assembly 407 for transporting media through the printer 400 (such as, for example, via driving rotation of the rolling platen 402), a controller 408 (including, for example, a processor, and static/permanent and/or volatile memory) for controlling operation of the printer 400 (such as, for example, signaling a drive assembly 407 to transport media 420 through the printer 400; providing a signal to a print head 401 to print particular information on the media; and/or signaling a cutter 403 to cut the media at a location, which cut may be based on a signal provided by a sensor 404 in sensing presence, absence, distribution, and the like of adhesive, perforations, creases, and the like, and/or one or more sense marks), and a communication module 409 for receiving print information (e.g., transaction data) and/or commands (e.g., print and/or knife cut commands) from an associated host computer or terminal (e.g., POS terminal) (not shown) and/or providing the same to the controller 408.

The printer 400 also includes one or more folders 406. The folder 406 folds media 420 either before the printer heads 401 or just before exit of the media 420 from the printer 400 (as shown in the FIG. 4). An adhesive activator or applier 405 may also be present to activate or apply adhesive as the media 420 exits the printer 400.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A printer, comprising:

a dual-sided thermal print mechanism; and a folding mechanism;

the dual-sided thermal printer mechanism configured to activate print images on a substrate that passes through the printer, the substrate coated on both sides with thermally sensitive inks, and the folding mechanism configured to custom fold the substrate before the substrate is dispensed from the printer.

2. The printer of claim 1, wherein the folding mechanism is a plow folder or a spiral folder integrated into the printer.

3. The printer of claim 1, wherein the folding mechanism is configured to perform a Z-fold on the substrate.

4. The printer of claim 1, wherein the folding mechanism is configured to utilize pre-existing perforations, creases, crimps, or die cuts on the substrate to assist in folding the substrate.

5. The printer of claim 1, wherein the folding mechanism is configured to utilize pre-existing perforations, creases, crimps, or die cuts on the substrate to assist in folding the substrate.

6. The printer of claim 1, wherein the folding mechanism is configured to be activated before or after the dual-sided thermal print mechanism activates the thermally sensitive inks on the both sides of the substrate.

7. The printer of claim 1 further comprising:

an adhesive application mechanism configured to selectively apply adhesive to the substrate as the substrate passes through the printer.

8. The printer of claim 7 further comprising:

a sealing mechanism configured to selective seal a portion of the substrate that is folded when the substrate passes through the printer.

9. A substrate, comprising:

a first side coated with thermally sensitive inks for activation when Passed through a dual-sided thermal printer;

a second side coated with the thermally sensitive inks for activation when passed through the dual-sided thermal printer; and a perforation applied to the substrate configured to permit the dual-sided thermal printer to fold the substrate along the perforation as the substrate is passed through the dual-sided thermal printer.

10. The substrate of claim 9 further comprising, an adhesive selected Coated on one or more sides of the substrate that seals a portion of the substrate when the substrate is folded by the dual-sided thermal printer along the perforation.

11. The substrate of claim 10, wherein the adhesive is configured to be activated by heat, ultraviolet light, or liquid.

12. The substrate of claim 9, wherein the substrate is configured to be custom cut from a web of media as the web is fed through the dual-sided thermal printer.

13. The substrate of claim 9, wherein the perforation is to be created on the substrate by the dual-sided thermal printer as the substrate passes through the dual-sided thermal printer.

14. The printer of claim 9, wherein the perforation is to be prefabricated on the substrate before the substrate passes through the dual-sided thermal printer.

15. A method residing in a non-transitory computer-readable medium and to execute on a dual-sided thermal printer, comprising:

selectively activating thermally sensitive ink on both sides of a substrate in accordance with a print job; and selectively folding a portion of the substrate in accordance with the print job.

16. The method of claim 15 further comprising, selectively applying adhesive to another portion of the substrate in accordance with the print job.

17. The method of claim 15 further comprising, selectively activating adhesive on the substrate in accordance with the print job or a type associated with the substrate.

18. The method of claim 15 further comprising, selectively sealing the portion of the substrate to another portion of the substrate when folded.

19. The method of claim 15, wherein selective folding further includes performing a z-fold on the substrate along the portion and another portion of the substrate.

20. The method of claim 15, wherein selective folding further includes folding along the portion that is a prefabricated perforation on the substrate to assist in folding the substrate.

* * * * *